United States Patent [19]

Olivieri

[11] Patent Number: 4,718,181

[45] Date of Patent: Jan. 12, 1988

[54] BINDING DEVICE, PARTICULARLY FOR SECURING THE FOOT TO A BEARING STRUCTURE OF A SPORTING IMPLEMENT

[75] Inventor: Oiviero Olivieri, Montebelluna, Italy

[73] Assignee: Icaro Olivieri & C.S.p.A., Italy

[21] Appl. No.: 881,365

[22] Filed: Jul. 2, 1986

[30] Foreign Application Priority Data

Jul. 2, 1985 [IT] Italy ..... 21396 A/85

[51] Int. Cl.[4] ..... A43B 5/04

[52] U.S. Cl. ..... 36/119; 24/68 SK; 280/11.3; 280/611

[58] Field of Search ..... 280/11.3, 11.33, 11.1 R, 280/11.19, 611; 36/119, 115; 24/68 SK, 68 R, 17 A, 70 SK

[56] References Cited

U.S. PATENT DOCUMENTS 31,280 1/1861 Gibbs ..... 280/11.3
4,196,530 4/1980 Delery ..... 36/119
4,565,017 1/1986 Ottieri ..... 36/119
4,575,956 3/1986 Paris ..... 36/119

*Primary Examiner*—David M. Mitchell
*Attorney, Agent, or Firm*—Sughrue, Mion, Zinn, Macpeak and Seas

[57] ABSTRACT

This binding device comprises a slide guided slidingly on and adjustably attached to the bearing structure of a sporting implement in a longitudinal direction to the slide; a strap is arranged arcuately across the bearing structure and has juxtaposed end portions associated adjustably with the structure and throughgoing seats are provided to prevent the strap from being shifted in the longitudinal direction. Formed in the slide are cam-like guides at an angle to the longitudinal direction, in engagement with respective counter-guides formed on the end portions of the strap.

This binding device is useful with many sporting implements, such as ski boots, skates, bicycle pedals, etc.

11 Claims, 8 Drawing Figures

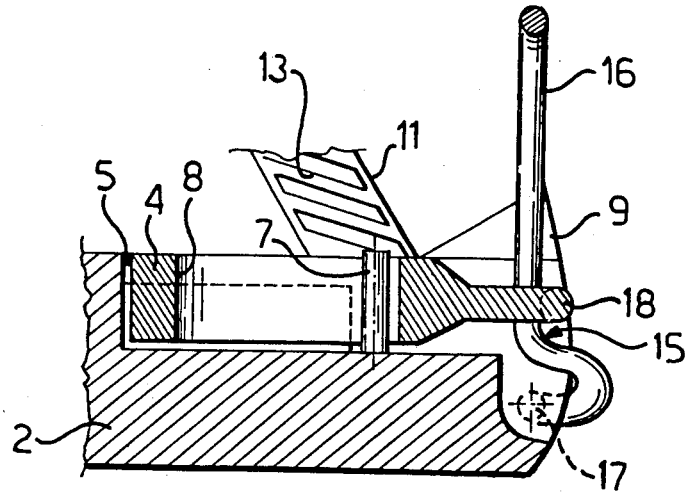
Fig-3
Fig-4
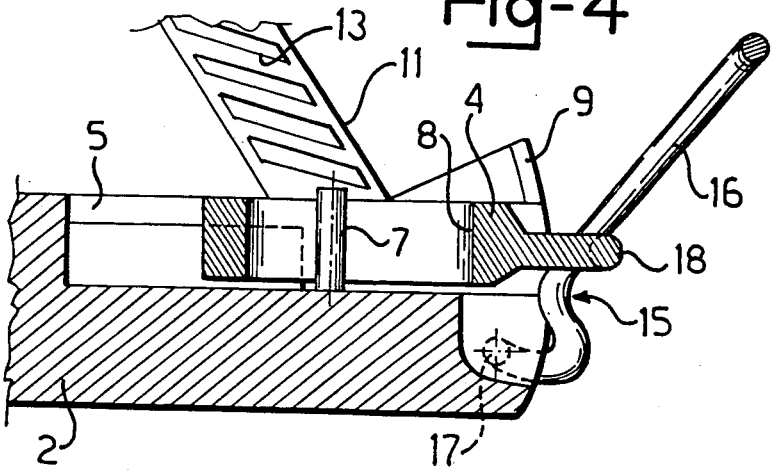

BINDING DEVICE, PARTICULARLY FOR SECURING THE FOOT TO A BEARING STRUCTURE OF A SPORTING IMPLEMENT

BACKGROUND OF THE INVENTION

The present invention relates in a most comprehensive way to a binding device, while being particularly but not exclusively suitable for fastening to the foot a bearing structure of a sporting implement. Reference is made in the ensuing description to this particular utilization of the binding device according to this invention, emphasizing the non-limitative character of that application.

In the practice of many sports, the need arises of securing the athlete's foot to the sporting implement, in order for the latter to form a whole with the athlete's body.

This is the case, for example, with skating, where the foot—with a shoe on—is secured to the skate frame, with water skiing, where the bare foot is made fast with the ski, with cycling, where the toe of the foot—with a shoe on—is strapped to the pedal; a seemingly slightly different but substantially equivalent situation is also encountered in skiing, where the foot is restrained in the boot.

More particularly, roller skates are provided—both at the toe and heel ends thereof—with a split strap in two parts, attached to either sides of the skate and connectable adjustably to each other by a buckle or tightening system, etc. A skate of this kind is illustrated, for example, in U.S. Pat. No. 4,433,458. To tighten the foot on the skate, the athlete is to completely unfasten the straps (or at least the rear one), put down his/her foot, and tighten the straps by manually applying a pull force directly thereto.

Water skis have a rest toe piece (adjustable or quite often fixed) and a heel piece quite similar to that of a roller skate, excepting that both the rests and straps are made of an elastic material, for a more comfortable fit.

Pedals of racing bicycles are also provided with an adjustable strap for securing the foot to the pedal, thus obviating the risk of the foot slipping off the pedal even in a situation of top physical effort.

With skiing, by contrast, the athlete's foot should be held fast within a rigid boot. To this end, several approaches have been proposed and utilized. Some of these provide, inside a boot, a saddle or the like rigid element which is pressed against the foot instep at the ankle, with attendant securement of the heel. For pressing the saddle down, a strap or cable system is often employed. As an example, European Patent Application No. 99504 discloses a ski boot wherein a saddle piece is pressed onto the foot instep by a cable wound around a drum mounted on the boot exterior and being hand actuatable.

All of the above prior devices have the problem of improving their functionality, making tightening proper and adjustment of the tightening tension easier to achieve.

SUMMARY OF THE INVENTION

It is an object of the present invention to provide a device which can solve the above problem, and which can be advantageously employed on a range of sporting implements, such as roller skates, ice skates, water skis, bicycle pedals, and ski boots.

This object is achieved, according to the invention, by a device as indicated, characterized in that it comprises a strap arranged arcuately across said bearing structure and having juxtaposed end portions associated adjustably with said structure, a means of inhibiting displacement of said strap with respect to said structure in said longitudinal direction, a slide guided slidingly on the bearing structure in a longitudinal direction thereof, at least two cam-like guides formed in the slide at an angle to said longitudinal direction, in engagement with respective counter-guides formed on said end portions of the strap, and a releasable means of stopping said slide on said structure.

Further features and advantages of a device according to the invention will be more clearly apparant from the following description of some embodiments thereof, given herein with reference to the accompanying drawings.

BRIEF DESCRIPTION OF THE DRAWINGS

FIGS. 3 and 4 are sectional views of the device of FIGS. 1 and 2, in those same two operative conditions;

DETAILED DESCRIPTION OF THE INVENTION

Figure 1:
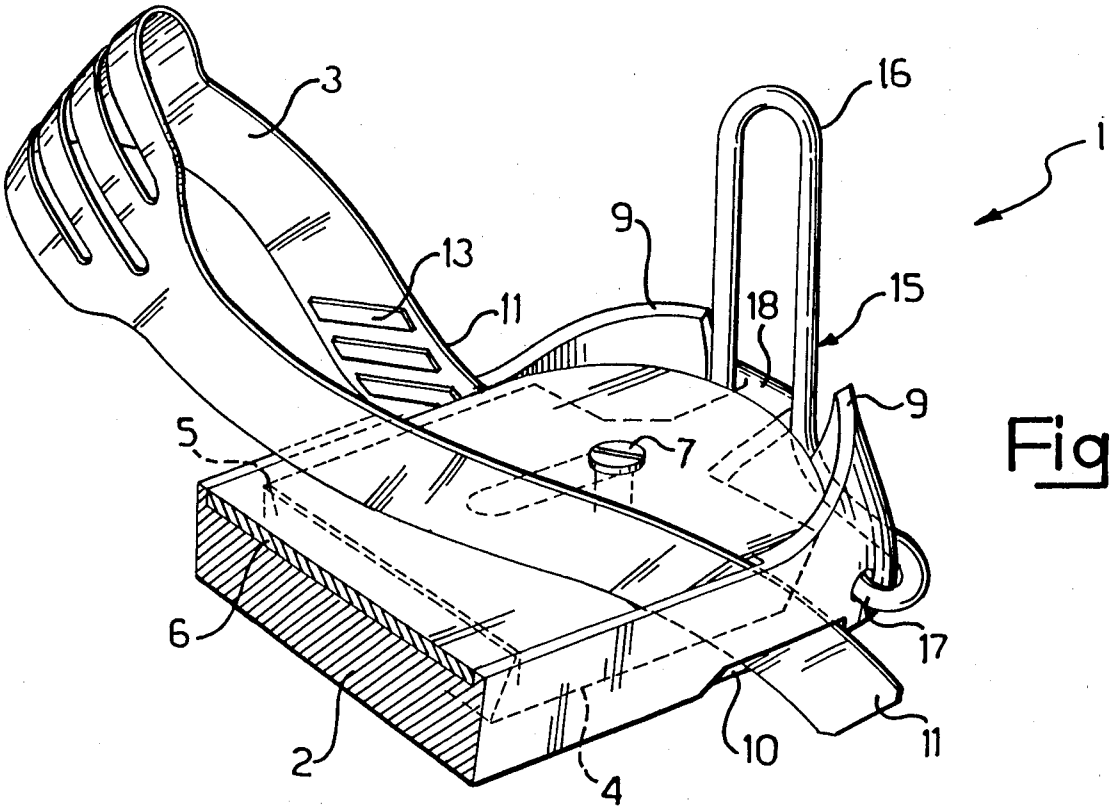
FIGS. 1 and 2 are perspective views showing diagramatically a binding device according to the invention, in two operative conditions thereof.
Figure 2:
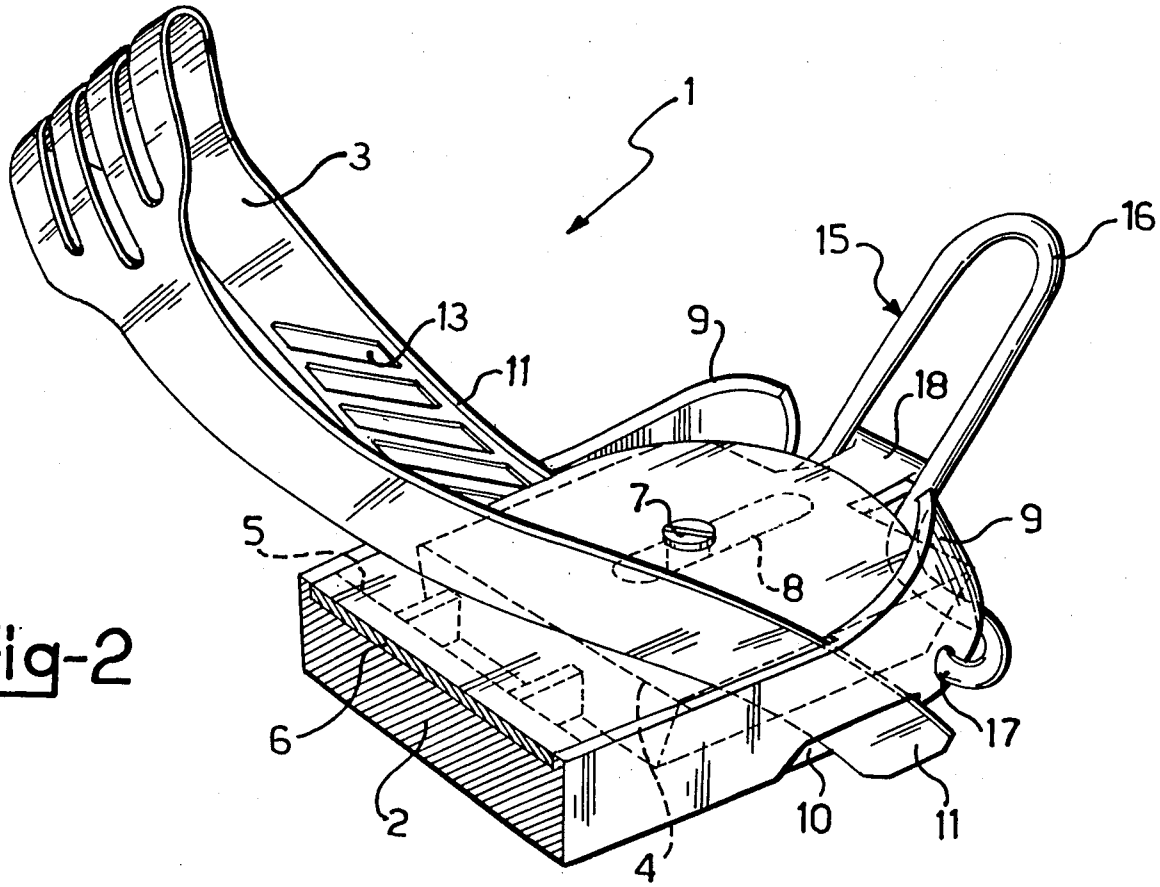
Figure 5:
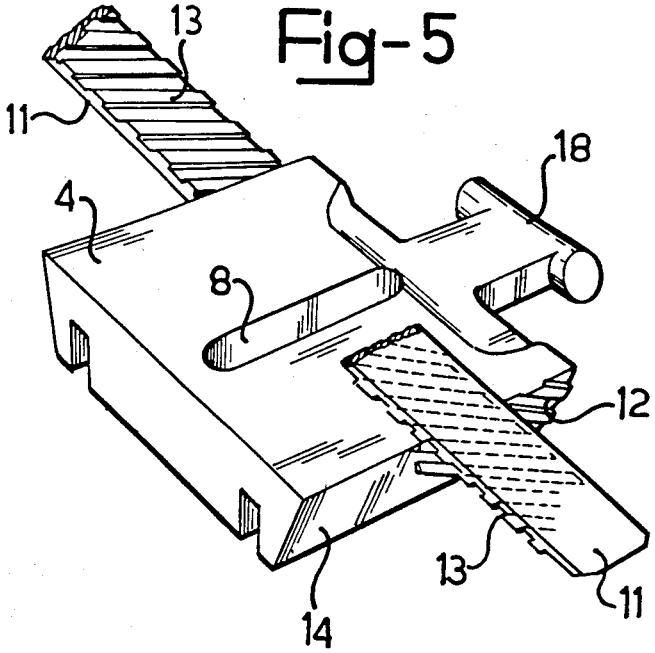
FIG. 5 is a perspective view of a detail of the device of the preceding figures.

With reference to FIGS. 1 to 5, a generic binding device 1 is described, particularly for securing the foot to such a sporting implement as a roller skate, a water ski, a bicycle pedal, a ski boot, etc. Of course, depending on the specific use, the binding device 1 would have different morphological features, an example whereof is given hereinafter.

The binding device 1 comprises a bearing structure 2 for a foot (not shown) and, at the foot ankle, a continuous strap 3 extending substantially arcuately across the bearing structure 2, and being bonded adjustably thereto in the manner to be described hereinafter.

On the structure 2, there is guided slidingly and stopped adjustably (in a manner known per se and no further shown), in a longitudinal direction, a slide 4; more particularly, the slide 4 is substantially plate-like and movable within a seat 5 formed in the structure 2 and being covered at the top by a covering plate 6, attached to the structure 2 by a screw 7 passed through an opening 8 in the slide 4. The structure 2 has two upward extending elevations 9 rearwardly thereof which form abutment seats for the piece of footwear.

Laterally of the slide 4, there are formed in the structure 2 two throughgoing seats 10, confronting the seat 5 and extending upwardly throughout the structure 2, in an oblique upward and forward direction. Into the seats 10, there are inserted juxtaposed end portions 11 of the strap 3. The throughgoing seats 10 prevent any movement of the strap 3 in the aforesaid longitudinal direction.

Two cam-like guides 12 are formed laterally on the slide 4, one on each side, and two counter-guides 13 are formed on the strap 3, one on each end portion 11. The cam-like guides 12 and the counter-guides 13 are in mutual engagement relationship and so shaped as to make a sliding forward movement of the slide 4 correspond to a downward sliding movement of the end portions 11.

More specifically, the cam-like guides 12 and counter-guides 13 comprise rectilinear parallel ribs formed on the slide 4 and on the end portions 11 of the strap 3 at an angle to the longitudinal sliding direction of the slide 4; advantageously, such ribs are spaced apart from one another by a distance substantially equal to the width of an individual rib and inclined on the longitudinal direction of sliding movement of the slide 4.

The slide 4 is also provided with two sunk side regions 14 flanking the cam-like guides 12.

The binding device 1 also comprises a means of displacing the slide 4 in the seat 5. That means comprises, for example, a lever 15 consisting of a shaped bar with a U-shaped actuating arm 16, and two side pins 17 bent inwardly and aligned. Engaged slidingly with the arm 16 is a hammer head 18 rigid with the slide 4.

The operation of the binding device 1 is as follows.

In order to secure the foot on the bearing structure 2, the athlete would lower the lever 15 dragging the slide 4 backwards; the end portions 11 of the strap 3 are thus caused to slide upwards and the strap 3 is slackened. Should the slackening be insufficient or eccessive, the athlete can depress the lever 15 further, until the counter-guides 13 on the end portions 11 disengage from the cam-like guides 12 on the slide 4 and locate instead in front of the sunk regions 14. In this condition, the athlete can shift the strap 3 manually, according to his/her requirements; thereafter, he/she would pull the lever 15 partway up to re-establish the engagement between the cam-like guides 12 and the counter-guides 13.

The athlete would now place his/her foot onto the bearing structure 2 slipping it under the slackened strap 3 from behind. The foot (possibly with a piece of footwear) bears rearwardly on the elevations 9. On pulling now the lever 15 all the way up, the strap 3 is tightened unfailingly on the foot.

As may be appreciated, a binding device according to the invention affords quick binding features, simply and effortlessly on slipping the foot in from the rear. While rapidity and simplicity are self-evident and command no explanation, as regards restriction of the effort involved in applying the binding, it is to be noted that, whereas with traditional devices the tightening pull should be applied directly to the strap axially thereof, with the inventive device, the pull force is exerted through a comfortable lever, at a step-down ratio (determined by the inclination angle of the cam-like guides) which is selected to make the tightening operation as easy as possible.

Figure 6:
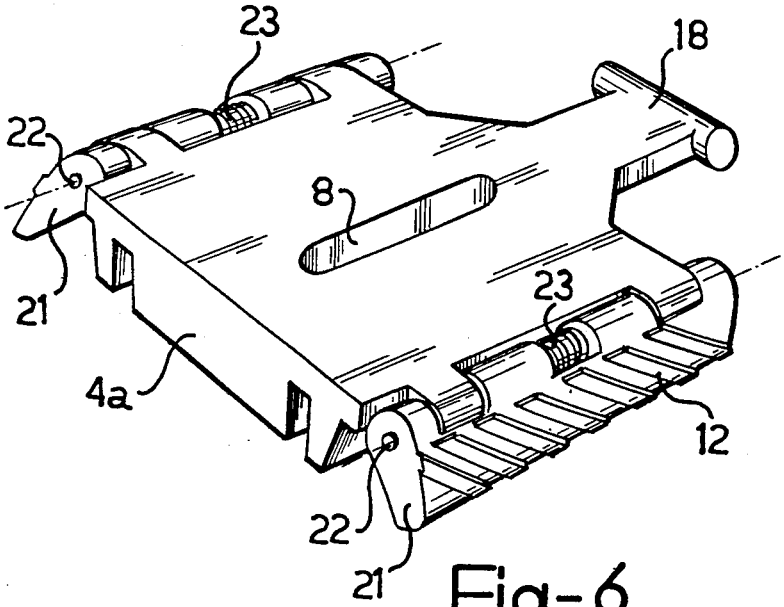
FIG. 6 is a perspective view of a variant detail of FIG. 5.

Shown in FIG. 6 is a slide 4*a* which is interchangeable with the slide 4; those parts of the slide 4*a* which are similar to the corresponding parts of the slide 4 are designated in the figure with the same numeral, and will not be described.

In the slide 4*a*, the cam-like guides 12 (again formed of rectilinear parallel ribs) are formed on two wings 21 linked pivotally to the slide 4*a* by means of side pins 22 extending horizontally lengthwise and being urged elastically upwards and outwards by torsion springs 23.

With the slide 4*a*, adjustment of the tightening tension is further simplified. In fact, to increase the tightening tension, it will be sufficient to push (with the strap 3 slackened, that is, the lever 15 down) the end portions 11 of the strap 3 downwards, merely overcoming the force of the springs 23 and causing one or more ribs to skip between the cam-like guides 12 and the counter-guides 13.

As may be appreciated from the foregoing description, a binding device according to the invention may be used to advantage, following appropriate adaptations, with a range of sporting implements where a foot is to be secured.

Figure 7:
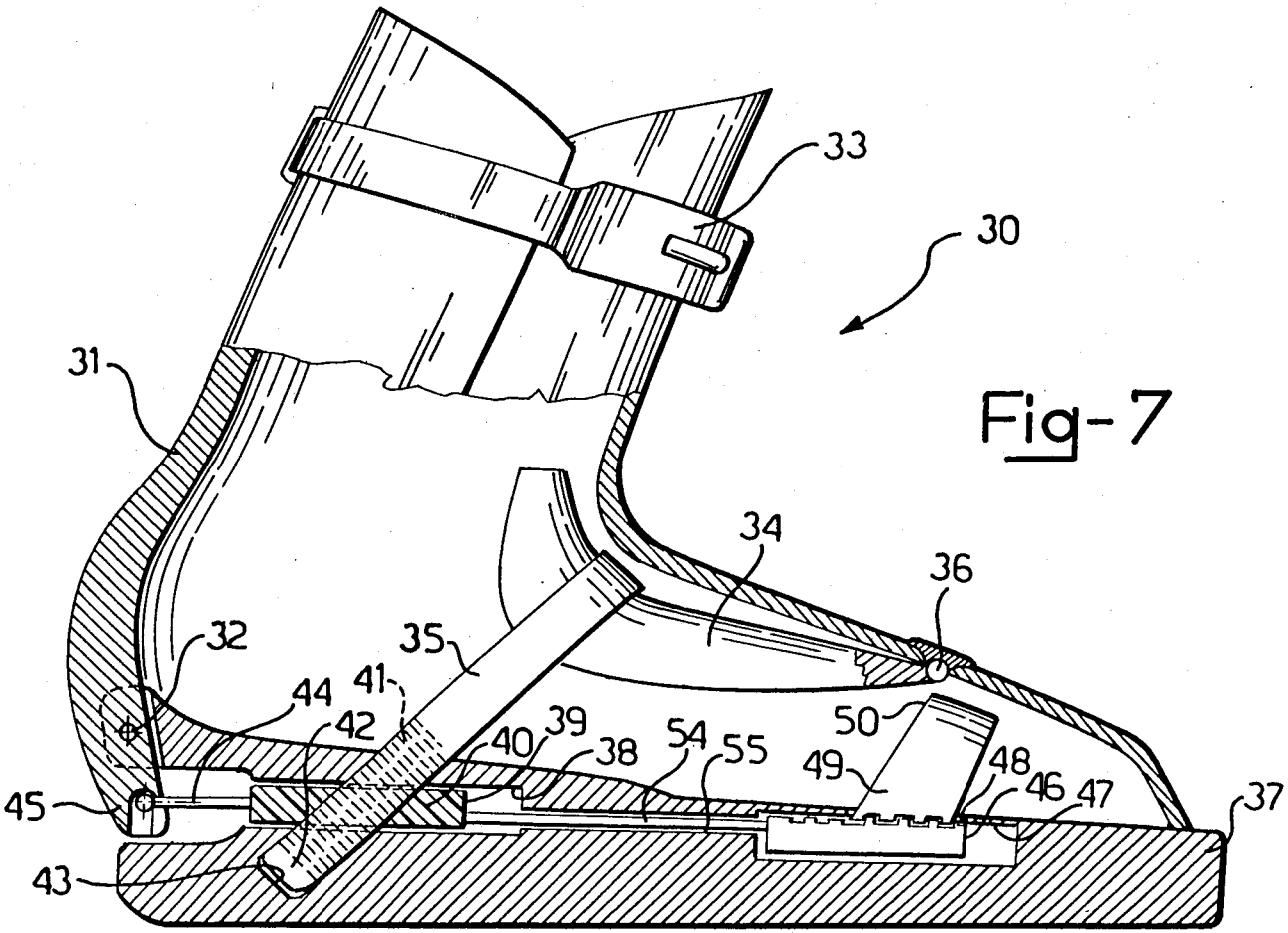
FIG. 7 is a part-sectional view of a ski boot incorporating a binding device according to the invention.
Figure 8:
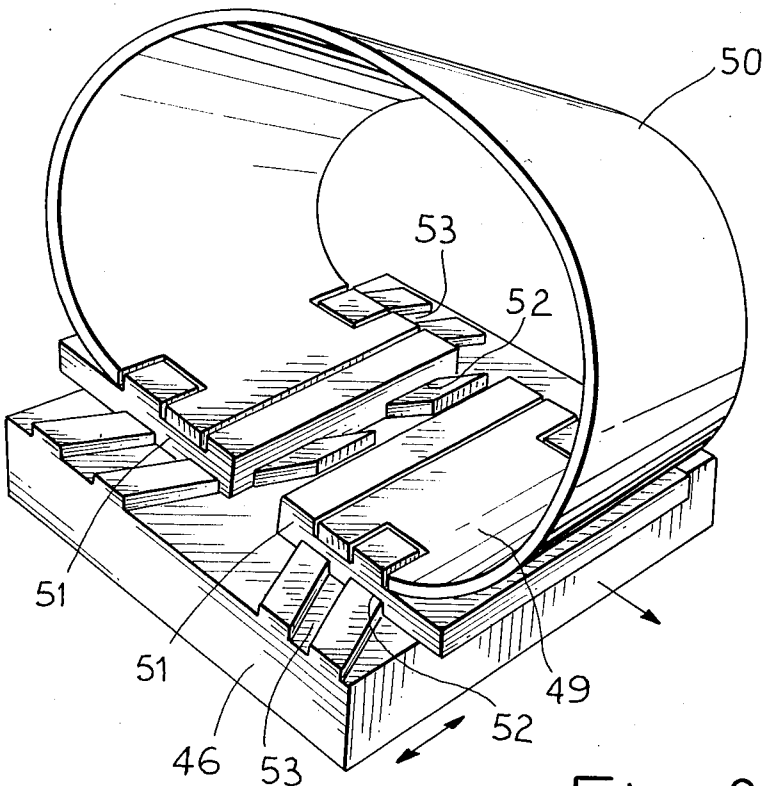
FIG. 8 is a perspective view showing diagramatically a detail of the boot of FIG. 7.

As an example, FIGS. 7 and 8 show a sport piece of footwear, in particular a ski boot 30 of the rear entrance type, wherein a rear wall 31 is tiltable around a pivot 32 to permit of the foot introduction. A traditional hook 33 holds the wall 31 in the tightened position of the binding.

Inside the boot 30, a binding device for releasably securing the foot at the ankle comprises a saddle piece 34 held pressed onto the foot instep by a strap 35 encircling the saddle piece 34, which is attached movingly to the boot 30 by a hinge 36.

Guided slidingly longitudinally in a seat 38 in the sole 37 of the boot 30 is a plate-like slide 39 provided laterally with cam-like guides 40 in engagement with counter-guides 41 on end portions 42 of the strap 35 which are inserted slidingly into respective vertical side seats 43 facing the seat 38. The cam-like guides 40 and the counter-guides 41 are so shaped as to make backward sliding of the slide 39 cause downward sliding of the end portions 42 of the strap 35.

The slide 39 is linked operatively to the wall 31, it being provided with a tie 44 hooked on a forked arm 45 rigid with the tilting wall 31 on the remote side from the pivot 32.

On then closing the boot (by lifting the tilting wall 31), the strap 35 is automatically caused to tighten itself onto the saddle piece 34, thus securing the foot.

On the boot 30, a binding device according to the invention would also be advantageously used to secure the foot toe end.

In the sole 37 of the boot 30, a slide 46 engages slidingly in a longitudinal seat 47 formed at the foot toe end. Two horizontal side seats 48 are formed in the sole 37 at the sides of the seat 47 and open toward it. In the seat 48 there are inserted juxtaposed end portions 49 of a strap 50 having heads 51.

The heads 51 of the end portions 49 are provided with respective counter-guides 52 in engagement with corresponding cam-like guides 53 formed on the slide 46. The cam-like guides 53 and the counter-guides 52 are shaped such that forward sliding of the slide 46 results in the end portions 49 of the strap 50 sliding outwards; advantageously, the cam-like guides 53 and the counterguides 52 comprise each a plurality of rectilinear parallel ribs set apart from one another by a distance which is substantially equal to the width of a single rib and being set at an angle to the longitudinal sliding direction of the slide 46.

The slide 46 is connected to the slide 39 by a tie 54, passed through a hole 55 in the sole 37, and is therefore movable therewith. Thus, closing the boot by closing the tilting wall 31 results in the rearward sliding of slides 39 and 46 and thus the tightening of straps 35 and 50.

It will be apparent that other applications of the invention, not specifically illustrated, are possible, as are other variants, without deviating from the protection scope defined in the appended claims.

I claim:

1. A binding device for securing a foot to a bearing structure of a sporting implement comprising:

a slide (4) engaged in the bearing structure for sliding movement in a longitudinal direction thereof;

a plurality of cam-like guides (12) disposed on opposite sides of said slide and extending at an acute angle to the longitudinal direction of movement of said slide;

means (15–18) for displacing said slide on the bearing structure in the longitudinal direction;

a strap (3) having two end portions (11) arranged arcuately across the bearing structure, said end portions having cam-like counter guides (13) forming a complimentary engagement with said cam-like guides; and means (10) disposed on the bearing structure for guiding said end portions and prohibiting said strap from moving in the longitudinal direction of movement of said slide;

wherein the movement of said slide in the longitudinal direction causes the strap to tighten or slacken in accordance with the relative movement of said guides and counter guides.

2. Device according to claim 1 wherein said cam-like guides are disposed on lateral sides of said slide.

3. Device according to claim 1 wherein said cam-like guides are disposed on an upper surface of said slide.

4. Device according to claim 1 further comprising wings pivotally secured on lateral sides of said slide with said cam-like guides being disposed on said wings.

5. Device according to claim 1, wherein said cam-like guides and said counter-guides comprise a plurality of rectilinear parallel ribs.

6. Device according to claim 1, wherein said means of preventing displacement of the strap in the longitudinal direction comprises throughgoing seats formed in said bearing structure for receiving said end portions of the strap.

7. Sporting piece of footwear, in particular a ski boot of the rear entrance type with a tilting rear wall to enable introduction of a foot and provided with a hook (33) for holding it in a tightened position, comprising a binding device for releasably securing the foot at an ankle portion, characterized in that said binding device comprises:

a first slide (39) engaged in said boot for sliding in a longitudinal direction thereof and operatively linked to said tilting rear wall fo the boot by means of a first tie (44) hooked on said wall;

a plurality of cam-like guides (12) disposed on oppoiste sides of said slide and extending at an acute angle to the longitudinal direction of movement of said slide;

a first strap (35) having two end portions arranged arcuately across said boot at the ankle, said end portions having cam-like counter guides (41) forming a complimentary engagement with the cam-like guides and being operatively linked to said slide, means disposed on said boot for guiding said end portions and prohibiting displacement of said strap in the longitudinal direction of movement of the slide; wherein the movement of said slide in the longitudinal direction causes the strap to tigthen or slacken in accordance with the relative movement of said guides and counter guides.

8. Footwear according to claim 7, further comprising a binding device for securing the foot at a toe end portion, comprising a second slide (47) guided slidingly in said boot in said longitudinal direction and being connected to said first slide by a second tie (54), a second strap (50) arranged arcuately across said boot at the toe end and having end portions operatively linked to said second slide, means for prohibiting displacement of said second strap in said longitudinal direction, a plurality of cam-like guides disposed on an upper surface of said second slide at an acute angle to the longitudinal direction of movement of said second slide, and a plurality of complimentary counter-guides disposed on heads rigidly secured to the end portions of the second strap.

9. Footwear according to claim 7, wherein said cam-like guides and said counter-guides comprises a plurality of complimentary rectilinear parallel ribs.

10. Footwear according to claim 8, wherein said means of inhibiting displacement of the second strap in the longitudinal direction comprises vertical seats disposed in said boot for receiving said end portions of the second strap.

11. Piece of footwear according to claim 8, wherein said means of inhibiting displacement of the second strap in said longitudinal direction comprises horizontal seats disposed in said boot for receiving said end portions of the second strap.

* * * * *